United States Patent [19]

Stahlecker

[11] Patent Number: 4,514,972

[45] Date of Patent: May 7, 1985

[54] PNEUMATIC CLEANING APPARATUS FOR OPEN END FRICTION SPINNING MACHINES

[75] Inventor: Fritz Stahlecker, Josef-Neidhart Strasse 18, 7347 Bad Ueberkingen, Fed. Rep. of Germany

[73] Assignees: Hans Stahlecker; Fritz Stahlecker, of DEX

[21] Appl. No.: 583,390

[22] Filed: Feb. 24, 1984

[30] Foreign Application Priority Data

Mar. 9, 1983 [DE] Fed. Rep. of Germany ..... 3308247

[51] Int. Cl.[3] ..... D01H 7/885

[52] U.S. Cl. ..... 57/301; 57/401

[58] Field of Search ..... 57/300, 301, 302, 304, 57/400, 401

[56] References Cited

U.S. PATENT DOCUMENTS 4,159,620 7/1979 LaFlaquiere et al. ..... 57/301

4,380,892 4/1983 Parker et al. ..... 57/301 X

*Primary Examiner*—Donald Watkins

*Attorney, Agent, or Firm*—Barnes & Thornburg

[57] ABSTRACT

Open-end friction spinning apparatus is disclosed which includes a plurality of commonly driven spinning units arranged adjacent one another and each including a friction roller pair defining a yarn forming wedge slot therebetween. To facilitate cleaning of the friction rollers, pneumatically operated cleaning nozzles are provided for each friction roller to be cleaned. Some arrangements have the cleaning nozzles fixedly disposed at each spinning unit, with actuating valves being controllable by a mobile servicing unit. In other arrangements the pneumatic cleaning nozzles are carried by a mobile servicing unit and are selectively moved to cleaning positions adjacent the friction rollers of respective spinning units to be cleaned.

22 Claims, 2 Drawing Figures

PNEUMATIC CLEANING APPARATUS FOR OPEN END FRICTION SPINNING MACHINES

BACKGROUND AND SUMMARY OF THE INVENTION

The invention relates to an open end friction spinning machine with a plurality of adjacently arranged spinning units, each having a pair of friction rollers driven in the same rotational direction and disposed to form a yarn forming wedge slot therebetween.

It is known (EP-OS 52 412) that the rollers of friction spinning units from time to time must be cleaned, especially after a thread break. With the known construction, it is therefore provided that one of the friction rollers can be moved away from the other so that the friction rollers and the wedge slot formed by them is accessible for a manual cleaning process. Such an arrangement exhibits disadvantages in that this work is tedious and the results are dependent upon the care of the servicing person. This construction also demands a high manufacturing expenditure, especially for the bearings for the rollers, because it is essential that the rollers are so carried that they maintain the exact relative bearing position when moved to their driving position. If the rollers are to be moved relatively to one another, the guide mechanism for this movement must therefore be provided with very close tolerances so that the indicated demands are fulfilled.

The invention is based upon the problem to create the possibility, with open end friction machines of the above-mentioned kind, to permit a cleaning of the rollers in a proper manner which is simple to accomplish and the results of which are not dependent upon the care of the servicing person.

These problems are thereby solved according to the present invention, in that pneumatic cleaning devices are provided to clean the rollers.

Because pneumatic devices are necessary for the operation of the open end friction spinning machine anyway (e.g., in conjunction with creating air flow for transport of fibers to the wedge slot), the additional expense for the provision of pneumatic cleaning devices is relatively small. The cleaning devices always function in the same manner so that the quality of the cleaning is not dependent upon the care of the servicing person. The pneumatic cleaning devices make it unnecessary for the rollers to be moved from their relative spinning positions for the cleaning process, thereby substantially simplifying the design demands for the rollers' bearings. In preferred embodiments, activation of the pneumatic cleaning devices occurs whenever the spinning procedure is interrupted, for example, after a thread break, after a spool change, or after a change of the material to be spun. The invention also contemplates embodiments which facilitate preventive servicing and cleaning operations for the rollers. Such embodiments can be automatically or otherwise controlled to clean the rollers after a predetermined running time of the rollers and/or after the production of a predetermined volume or length of yarn.

In practical embodiments of the invention, at least one cleaning nozzle is provided for each roller, which nozzle is connected at an overpressure source and/or underpressure source by means of pneumatic lines which contain activating and/or switch over valves. Such embodiments are especially advantageous if one is using hollow friction rollers with perforated cover surfaces, wherein fiber fly, fiber dust and/or fiber residue is deposited inside of the rollers. These contaminants can be loosened and removed with the pneumatic cleaning arrangements of the invention, especially by alternating between overpressure and underpressure via the nozzles. In especially preferred embodiments of the invention, it is advantageously provided that the cleaning nozzles are formed as slot nozzles extending over approximately the length of the rollers.

In advantageous embodiments of the invention, it is provided that a cleaning nozzle is disposed at the wedge slot formed by the rollers. Such a cleaning nozzle, which preferably is connected at an underpressure source, can also be advantageously used during a start spinning procedure, for example, in order to transport away the fibers which are not desired and which are returned by a fiber feeding and opening device, before the actual start spinning process.

In further embodiments of the invention, it is provided that a cleaning nozzle is arranged at the circumference of each roller. This arrangement is especially advantageous with hollow rollers with perforated cover surfaces because it facilitates removal of the contaminants which deposit inside of the rollers during spinning operations. It is advantageously provided in certain embodiments that the cleaning nozzles are arranged at the circumferences of the rollers and are connected at an overpressure source. Thereby it is possible to loosen the contaminants by high pressure air and then to suck them off through a further cleaning nozzle connected to an underpressure (vacuum pressure) source.

In still further embodiments of the invention, a travelling maintenance unit is provided which is adjustably movable to each of the spinning units and which is outfitted with apparatus for activating the pneumatic cleaning nozzles. Thereby it is achieved that not only the quality of the cleaning, but also the accomplishment of the cleaning is automated so that improper servicing is avoided.

In further embodiments of the invention it is provided that the maintenance unit is provided with mechanisms for interrupting the operational drive of the rollers at the spinning unit to be cleaned. It is especially advantageous if the maintenance unit is further provided with adjustable means to drive the rollers at the respective spinning units. Thereby it is possible to loosen the rollers from the drive for the spinning operation and additionally to drive the rollers with a more suitable velocity for the cleaning operation.

Further objects, features, and advantages of the present invention will become more apparent from the following description when taken with the accompanying drawings which show, for purposes of illustration only, an embodiment in accordance with the present invention.

DETAILED DESCRIPTION OF THE DRAWINGS

Figure 1:
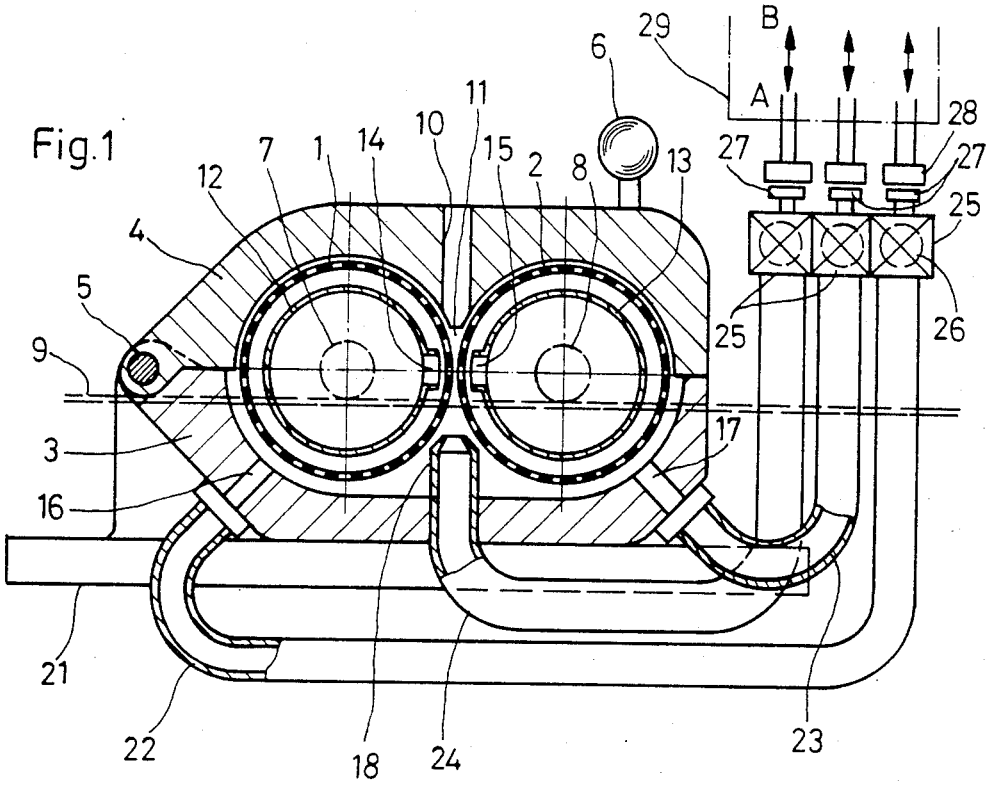
FIG. 1 is a part sectional view through a spinning unit of an open end friction spinning machine constructed in accordance with a preferred embodiment of the invention with three pneumatic cleaning nozzles which are actuable by means of a travelling maintenance unit.

In FIG. 1, a spinning unit of an open end friction spinning machine is only partially and schematically illustrated. The open end friction spinning machine includes a plurality of similar spinning units which are arranged adjacent one another. The spinning unit possesses two friction rollers, 1 and 2, which are arranged adjacently parallel to one another and form a yarn forming wedge slot 11. The two rollers 1 and 2 have a perforated cover surface and respective suction inserts 12 and 13 inside this cover surface. The suction inserts are connectable at an underpressure source and open with respective slot shape openings 14 and 15 facing the cover surface in the region of the wedge slot 11. The rollers 1 and 2 are provided with axles 7 and 8 (shown in dash lines in FIG. 1) which are driven in the same rotational direction by a common tangential belt 9 running in the machine longitudinal direction.

Single open fibers from opened fiber material are guided to the wedge slot 11 by means of a fiber feed channel 10 and are turned or twisted together to form a yarn in the wedge slot 11. The yarn is drawn off in the longitudinal direction of the wedge slot 11 by means of a not illustrated withdrawal device, which withdrawal device includes a roller pair. Following the roller pair the yarn extends to a spooling device where it is wound on a spool.

The two rollers, 1 and 2, are arranged in a housing that is formed of a stationary part 3 at the opposite side of the servicing side of the spinning unit and part 4 which is pivotably held at pivot 5 with respect to part 3. The stationary part 3 of the housing is provided with a flange 21 which is fastenable at a machine frame part. The separating gap between the two housing parts 3 and 4 extends approximately through the common plane of the two rollers 1 and 2. The pivotable part 4, the so-called pivot cover, includes the fiber feed channel 10 and is provided with a hand grip 6 to facilitate the opening thereof. The closing movement results by means of a not illustrated spring disposed in the region of the hinge 5.

There are three cleaning nozzles 16, 17, 18 arranged in the stationary housing part 3, which are formed respectively as slot nozzles extending over the whole length of the cover surface of the rollers 1 and 2. The cleaning nozzle 18 is arranged at the wedge slot 11 and is disposed oppositely of the fiber feed channel 10 at the wall disposed at the side of the wedge slot 11 opposite the location where the yarn formation takes place. The two cleaning nozzles 16 and 17 are arranged respectively adjacent the outer coating surface of the respective rollers 1 and 2. The cleaning nozzles 16, 17, and 18 are connected by means of lines 22, 23, 24 at suction lines 26 (shown in dash lines) by means of valves 25. Valves 25 are advantageously arranged in a common region at the servicing side of a spinning unit, preferably at a holding plate. Valves 25 are provided with activating knobs 27 for accomodating activation and connection of the cleaning nozzles 16, 17, and 18 with the connected pressure lines 26. Upon activation of the pressure knobs 27, there results a suction cleaning of the rollers 1 and 2. Embodiments are also contemplated with one or more of the cleaning nozzles 16, 17, and 18 selectively connected in a corresponding manner as described above, but at overpressure lines so that then the cleaning of the rollers 1 and 2 is effected with high pressure air streams. Furthermore, it is also contemplated by the invention to include both underpressure (vacuum) lines 25 and high pressure lines selectively controlled with the valves 25 and lines 22, 23, 24 to the cleaning nozzles 16, 17, and 18 so that respectively after activation of the valve 25 a suction or blowing results, and intermittent, sequential and alternating application of suction and blowing cleaning effects at the cleaning nozzles.

The pressure knobs 27 can be operated by hand by a servicing person. In order to automate the open end friction spinning machine, a travelling maintenance unit 28 is provided, illustrated in dash lines. The maintenance unit 28 can be part of a travelling wagon or cart travelling along the open end friction machine and which respectively stops at each spinning position and then carries out a servicing operation, which also includes the above explained cleaning operation. The maintenance device 29 includes pressure connectors 28 for actuating the pressure control knobs 27 of the valves 25. In preferred embodiments the maintenance unit 29 includes a program control for controlling the operation of the knobs 27 in a predetermined time sequence to facilitate optimum cleaning with application of suction/blowing at one or more of the cleaning nozzles 16, 17, and 18.

It is also contemplated by the invention to provide the lines 22, 23, and 24, instead of with valves, with connection pieces which are so arranged with respect to and connectible with connection pieces of the maintenance unit that the cleaning procedure can be effected and controlled from the maintenance device 29. That is, the maintenance device would carry the pressure/-vacuum sources rather than just actuators as in the illustrated embodiments.

It is also contemplated by the invention to provide a travelling maintenance unit extending along the open end friction spinning machine which maintenance unit is provided with an adjustable construction part corresponding essentially to the cover 4. This maintenance construction part is then outfitted with cleaning nozzles which are arranged mirror symmetrically relative to the common plane of the two rollers 1 and 2 as shown in FIG. 1. The maintenance unit is then provided or outfitted with apparatus for opening the swingable or pivotal cover 4. For example, the maintenance unit could include a pneumatically or hydraulically actuated piston cylinder arrangement for engaging handle 6 and moving cover 4 to an open position. Thereafter the maintenance unit construction part containing the cleaning nozzles is adjustably moved to abut the stationary part 3 and form a closed roller housing to accomplish the cleaning operation with the suction and pressurized air at the cleaning nozzles as described above for the FIG. 1 arrangement. This just described embodiment is more economical because the cleaning nozzles and the necessary valves for their activation and control devices, respectively, only need to be provided one time, namely at the maintenance unit.

Figure 2:
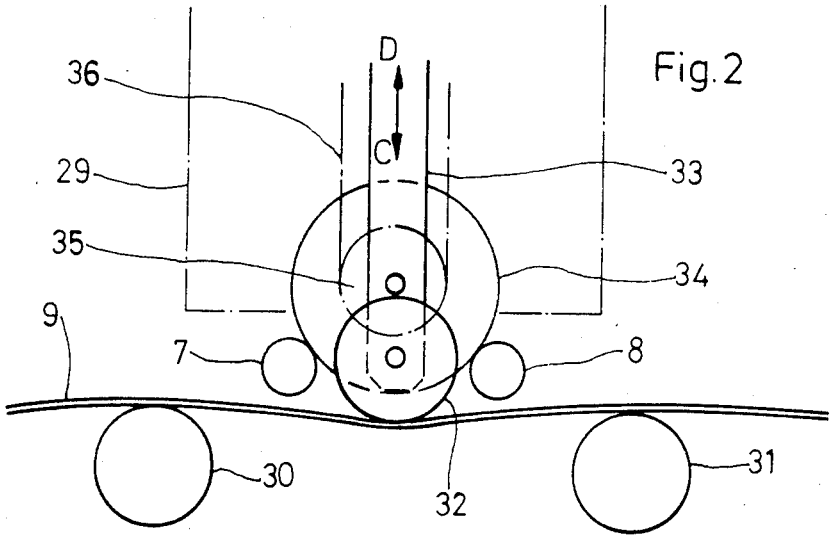
FIG. 2 is a schematic illustration of means at a maintenance unit for interrupting the operational driving of the rollers and driving the rollers for cleaning operations, constructed according to the present invention.

During the cleaning process, especially with a process with an automatic maintenance unit 29, it is advantageous if the drive of the rollers 1 and 2 is interrupted and if the rollers 1 and 2 are driven with a velocity which optimizes the cleaning process. For this reason, as shown in FIG. 2, the maintenance unit 29 is provided with an adjustable lever 33 movably adjustable with respect to respective spinning units. Lever 33 carries an adjustable lifting roller 32 insertable between the axles 7 and 8 of the spinning unit to engage tangential belt 9 between the two tension back-up rollers 30 and 31 and so lift the belt 9 from the axles 7 and 8 to interrupt the drive. A driving roller 34 is also arranged on lever 33, which roller 34 abuts against the circumference of axles 7 and 8 and drivingly rotates the axles 7 and 8 via a disk 35 and a chain or a tooth-belt 36 or the like. In this arrangement the maintenance unit 29 can effect the drive of the rollers 1 and 2 with a velocity which is especially suitable for the cleaning process.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Open end friction spinning apparatus comprising:

a plurality of spinning units having respective friction roller pairs disposed to form yarn forming wedge slots therebetween, and pneumatic cleaning means for cleaning the friction roller.

2. Apparatus according to claim 1, wherein said pneumatic cleaning means includes at least one cleaning nozzle for each roller of a respective spinning unit to be cleaned, and pneumatic line means communicating the at least one cleaning nozzle with pneumatic pressure means.

3. Apparatus according to claim 2, wherein control valve means are disposed in said pneumatic line means to control the pressure at the at least one cleaning nozzle.

4. Apparatus according to claim 2, wherein said cleaning nozzles are formed as slot nozzles extending approximately along the length of a friction roller to be cleaned thereby.

5. Apparatus according to claim 1, wherein said pneumatic cleaning means includes a cleaning nozzle opening into the region of the wedge slot formed between the friction rollers of a respective spinning unit to be cleaned, and pneumatic line means communicating said cleaning nozzle with pneumatic pressure means.

6. Apparatus according to claim 3, wherein said pneumatic cleaning means further includes a further cleaning nozzle opening into the region of the wedge slot formed between the friction rollers of a respective spinning unit to be cleaned, said further cleaning nozzle being communicated by further pneumatic line means with a pneumatic pressure means.

7. Apparatus according to claim 3, wherein one of said cleaning nozzles is disposed at the circumference of each roller of a respective spinning unit to be cleaned.

8. Apparatus according to claim 6, wherein one of said cleaning nozzles is disposed at the circumference of each roller of a respective spinning unit to be cleaned.

9. Apparatus according to claim 7, wherein said cleaning nozzles extend tangentially to the circumference of the respective associated rollers to be cleaned thereby, and wherein said pneumatic pressure source includes a high pressure source for supplying high pressure air to said cleaning nozzles.

10. Apparatus according to claim 3, wherein each spinning unit is provided with fixedly arranged cleaning nozzles.

11. Apparatus according to claim 10, wherein said cleaning nozzles are arranged in a roller housing means which at least partially surrounds the friction rollers of a respective spinning unit.

12. Apparatus according to claim 11, wherein a mobile servicing unit is provided which is adjustably movable to individual spinning units, said mobile servicing unit including cleaning nozzle activating means for activating the cleaning nozzles at a respective spinning unit to be cleaned.

13. Apparatus according to claim 12, wherein said nozzle activating means includes devices for selectively controlling the control valve means at respective spinning units to be cleaned.

14. Apparatus according to claim 12, wherein said pneumatic line means includes fixed connections at the respective spinning units, and wherein said mobile servicing unit is provided with counter connections which are abuttingly engageable with the fixed connections at the respective spinning units to operatively connect them together.

15. Apparatus according to claim 13, wherein a common holder unit is provided for holding the pneumatic line connections/control valve means at each spinning unit.

16. Apparatus according to claim 14, wherein a common holder unit is provided for holding the pneumatic line connections/control valve means at each spinning unit.

17. Apparatus according to claim 1, wherein a mobile servicing unit is provided which is adjustably movable to individual spinning units, said mobile servicing unit including pneumatic cleaning means which are adjustably movable and operable to clean the friction rollers of respective individual spinning units.

18. Apparatus according to claim 17, wherein said mobile servicing unit includes means to interrupt the operational drive of the friction rollers at a spinning unit to be cleaned.

19. Apparatus according to claim 12, wherein said mobile servicing unit includes means to interrupt the operational drive of the friction rollers at a spinning unit to be cleaned.

20. Apparatus according to claim 18, wherein said mobile servicing unit includes adjustable driving means for driving the rollers independently of the machine operational drive during cleaning operations at a respective spinning unit.

21. Apparatus according to claim 19, wherein said mobile servicing unit includes adjustable driving means for driving the rollers independently of the machine operational drive during cleaning operations at a respective spinning unit.

22. Apparatus according to claim 20, wherein said adjustable driving means includes a rotatably driven friction wheel which is configured to drivingly engage the circumference of the friction roller axles.

* * * * *

UNITED STATES PATENT AND TRADEMARK OFFICE

CERTIFICATE OF CORRECTION

PATENT NO. : 4,514,972

DATED : May 7, 1985

INVENTOR(S) : Fritz Stahlecker

It is certified that error appears in the above-identified patent and that said Letters Patent is hereby corrected as shown below:

On the title page Item (73) "DEX" should read

-- Federal Republic of Germany --.

Signed and Sealed this

*Twenty-first* Day of *January 1986*

[SEAL]

*Attest:*

DONALD J. QUIGG

*Attesting Officer*

*Commissioner of Patents and Trademarks*